US005101583A

United States Patent [19]

Scordilis

[11] Patent Number: 5,101,583

[45] Date of Patent: Apr. 7, 1992

[54] ARTICULATED TOOTHED EXCAVATING DRUM FOR ROAD SIDE DITCHES OF DESIRED PROFILE

[76] Inventor: Andreas Scordilis, 73 Pinetree Ct., Inman, S.C. 29349

[21] Appl. No.: 602,688

[22] Filed: Oct. 24, 1990

[51] Int. Cl.[5] ..... E02F 5/08

[52] U.S. Cl. ..... 37/91; 37/80 A; 37/189; 299/39; 299/80

[58] Field of Search ..... 299/39, 80; 37/189, 37/91, 94, DIG. 16, 80 A, 70, 92, 93, 95

[56] References Cited

U.S. PATENT DOCUMENTS

| | | | |
|---|---|---|---|
| 2,942,360 | 6/1960 | Hawkins et al. | 37/91 |
| 3,461,579 | 8/1969 | Turner | 37/189 |
| 3,574,989 | 4/1971 | Rousseau | 37/91 X |
| 4,236,857 | 12/1980 | Willi | 37/70 X |

FOREIGN PATENT DOCUMENTS

| | | | |
|---|---|---|---|
| 827737 | 12/1951 | Fed. Rep. of Germany | 37/91 |
| 1388165 | 6/1965 | France | 37/91 |
| 86255 | 4/1957 | Netherlands | 37/91 |

*Primary Examiner*—David H. Corbin
*Assistant Examiner*—Arlen L. Olsen

[57] ABSTRACT

A ditch digging and/or cleaning apparatus designed to cut a multitude of ditch profiles includes a rotating drum on which are permanently attached tooth supports. On these supports are fastened spikes and teeth, different types for different terrain. Removed ditch material can either be dispersed to the right or windrowed to the left of the rotating drum, over the far side bank or the road side bank of the ditch, by rotatably positioning the drum.

A frame is employed to support the rotating drum, to position it to the various working positions and to connect it to the carrier vehicle. This frame consists of a fixed section that connects to the carrier vehicle and a rotatable section that supports the rotating drum. Also included are fixed and movable deflectors that direct the material flow to the desired direction. This frame can be attached on tractor pulled and powered carriers, or on self propelled extending boom carriers.

10 Claims, 7 Drawing Sheets

ARTICULATED TOOTHED EXCAVATING DRUM FOR ROAD SIDE DITCHES OF DESIRED PROFILE

BACKGROUND

1. Field of the Invention

This invention relates to ditching operations and in particular to the forming of ditches with desired profile, and to cleaning existing ditches of multiple profiles.

2. Description of the Background Art

Current ditching operations employ the use of either heavy equipment equipped with a scraping blade or a bucket, or of rotating drum(s) that are mechanically or hydraulically driven and supported by a carrier. The rotating drum(s) ditching machines are considered an improvement when compared to the blade or bucket carrying equipment due to their speed and low cost operation. This invention belongs to the rotating drum(s) ditching machines, which are hereby considered "prior art". The prior art employs one or more drums of cylindrical or conical section that accomplish a ditch of a fixed trapezoidal profile. Harder grounds require narrow ditches, while softer grounds require wide ditches with gradual slopes to reduce the possibility of the bank walls collapsing. Shallower or wider ditches are achieved by multiple passes of the ditching machine over the same stretch of ditch, while positioning the rotating drum(s) at different transverse or angular positions. Since deep ditches with bank inclination 1:1 or steeper are not considered capable of supporting vegetation growth, shallow ditches with a bank inclination 2:1, 3:1 etc. are becoming more desirable recently due to environmental reasons.

One known trencher (U.S. Pat. No. 4,535,555) provides multiple ditch profiles by having adjustable inclination wheels, but it is intended for off-road use since it throws ditch material on both sides and due to its weight, complexity, and power requirements, is powered and supported by a large off-road carrier.

The prior art stands in need of considerable improvement with regard of providing a simple, lightweight roadside ditching machine, that produces the desirable ditch profile in one pass and discharge the excavated material either to the far side, or to the road side of the ditch for later pick-up.

3. Summary

The present invention comprehends an improved method and apparatus for cutting and/or cleaning ditches of multiple profiles, employing one rotating drum of conical-cylindrical section. This drum is positioned to accomplish the desired ditch profile by rotating its supporting frame against a fixed frame that is attached to the carrier. By rotating the supporting frame around the vertical axis the multiple ditch-profiles are achieved. The transmission of mechanical power at all drum positions is attained by the cooperation of two right angle gearboxes, one of which is fastened to the fixed frame while the other onto the rotatable frame. One through driveshaft is connecting the gearboxes at all angles and one remotely controlled hydraulic cylinder positions the rotatable frame. The power transmission to the drum is completed by a gear, chain or belt transmission depending on the required horsepower and drum size. The rotating drum is positioned to its various working positions by means of articulation as shown in the attached drawings.

It should be noted here that different slopes (e.g. 1:1, 2:1 etc.) can be cut by using different cross sectioned drums.

BRIEF DESCRIPTION OF THE DRAWINGS

A preferred form of my invention is illustrated in the attached drawings wherein.

DETAILED DESCRIPTION OF A PREFERRED EMBODIMENT

Figure 1A:
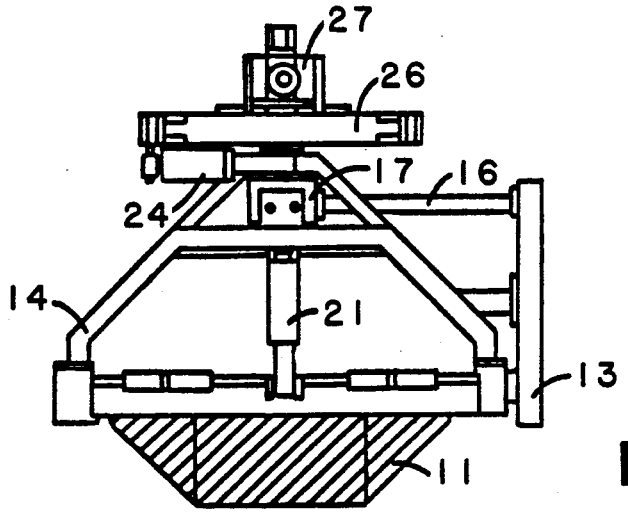
FIGS. 1A, 1B and 1C are schematics of elevational views, front, side and rear of the apparatus.
Figure 1B:
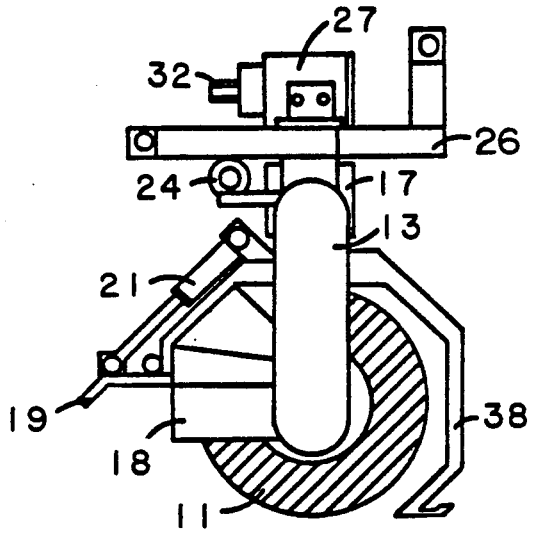
Figure 1C:
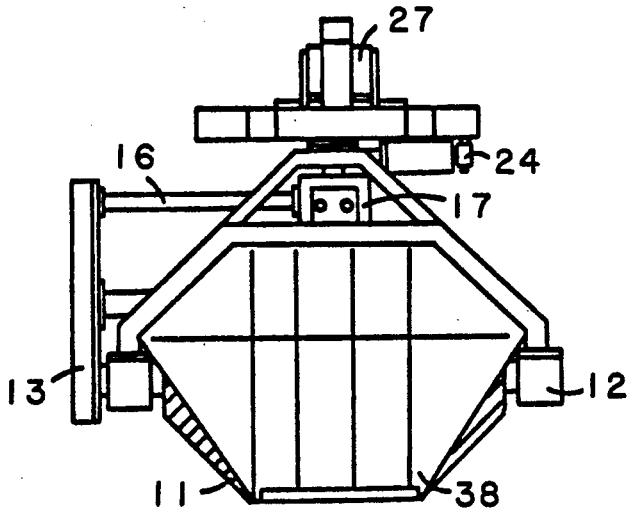
Figure 2:
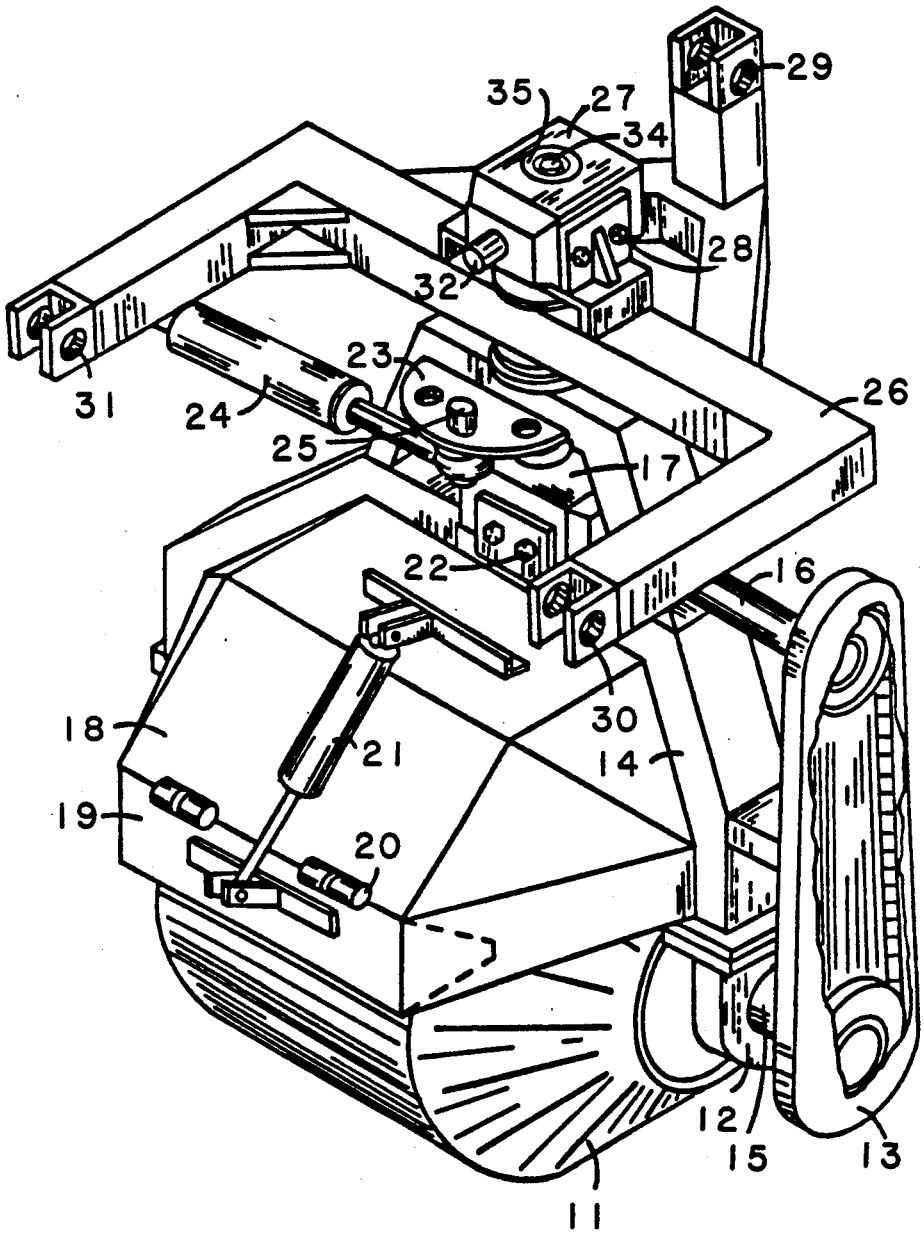
FIG. 2 is an isometric view of the complete apparatus.
Figure 3:
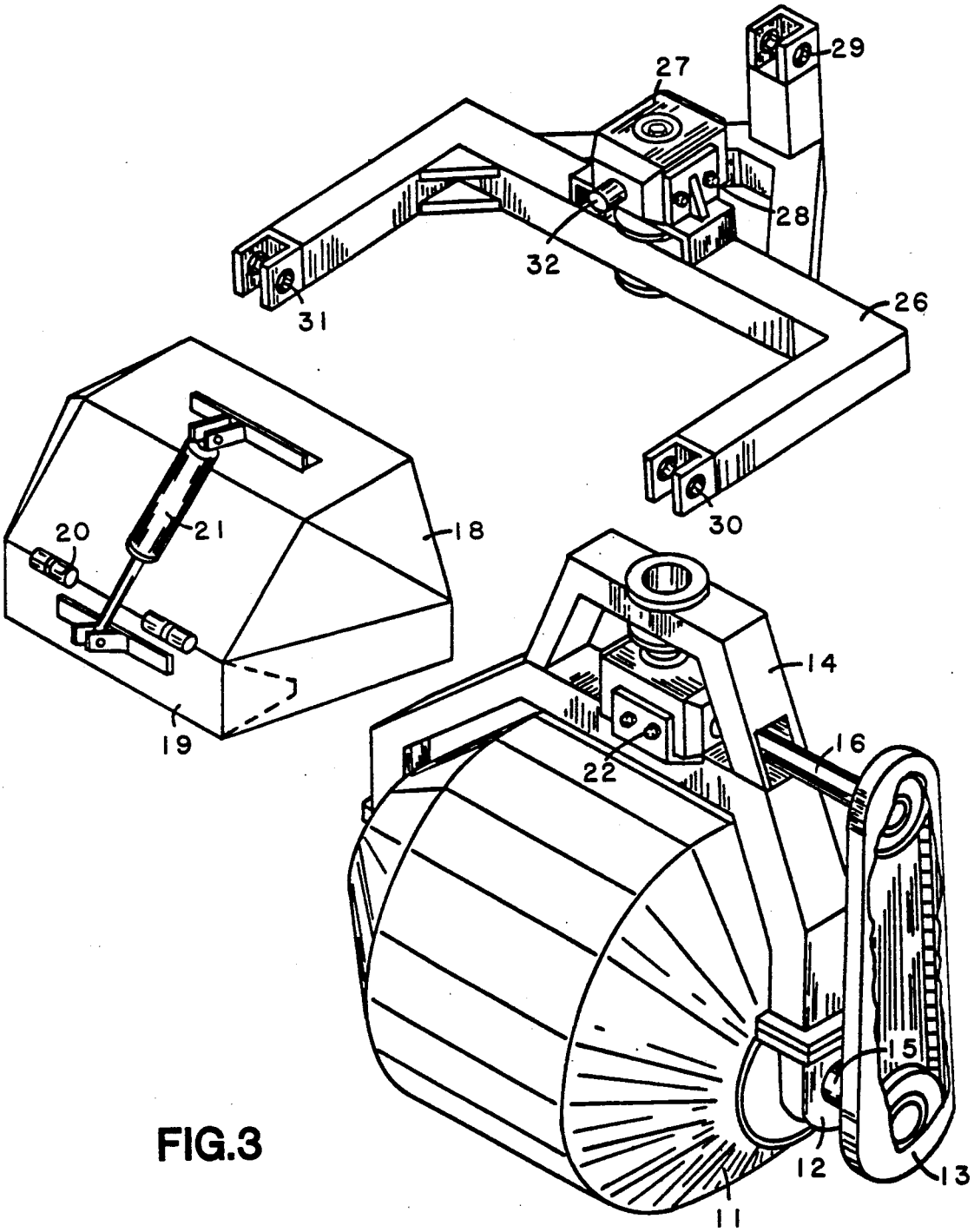
FIG. 3 is an isometric view of the main parts of the apparatus: fixed frame, front panels and rotatable frame with working drum.

Referring to FIGS. 1 to 7 the drum 11 is supported on both sides by mounted bearings 12. The transmission unit 13 includes a casing fixed to the rotatable frame 14 and the necessary pulleys (or sprockets) and belts (or chains). The lower pulley is keyed to the drum shaft 15 and the upper to the output shaft 16 of the lower gearbox 17. The rotatable part of the apparatus includes flow controlling panels 18. The lower part of the panel assembly is a movable door 19 that is pivoted around hinges 20 by a hydraulic cylinder 21. The lower gearbox 17 is fixed onto the rotatable frame 14 by bolts 22. The rotatable frame 14 is positioned by a second hydraulic cylinder 24, one end of which is attached to the fixed frame 26 and the other to a disc 23 that is fixed to the rotatable frame 14 by a pin 25. The disc 23 provides one central and two outer pin positions to facilitate a full 180 degree frame rotation in cooperation with the stroke of the hydraulic cylinder 24.

The upper frame 26 is attached to the carrier, by hitch pins at the positions 29, 30 and 31. The upper gearbox 27 is fixed to the frame by bolts 28. The carrier output shaft is connected to the gearbox input shaft 32 by means of a telescopic driveshaft 71 FIG. 7.

A through shaft 33 is connecting the upper gearbox 27 and the lower gearbox 17. Both gearboxes 27 and 17 are of the hollow shaft type. This through shaft 33 is held in place on one end by a bolt 34 and a washer 35 and on the other end by a washer 36 and a retainer ring 37.

A skid 38 is fixed at the rear of the drum 11 to provide a smooth ditch bottom. In extreme cases when the drum 11 is positioned beyond a middle range, that is when the pin 25 of the cylinder 24 is attached to the outer holes of the disc 23, the skid 38 has to be removed.

Figure 4A:
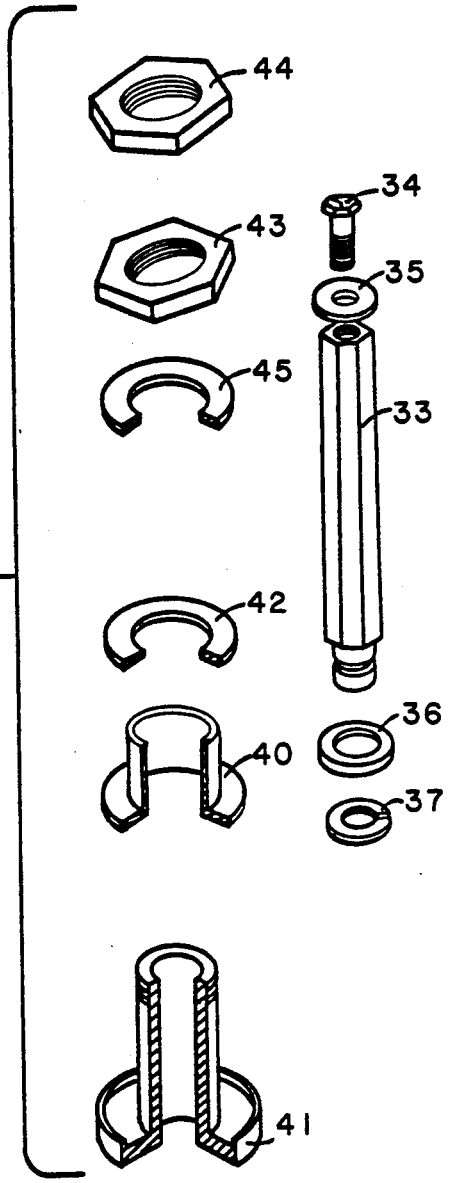
FIG. 4A is an isometric view of the frame connecting components.
Figure 4B:
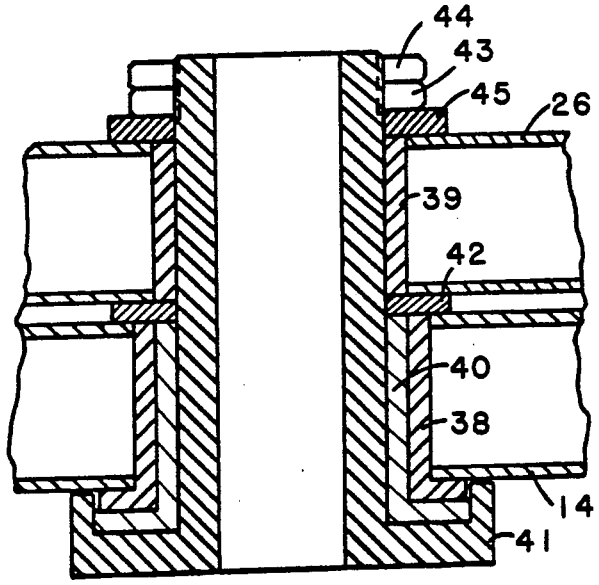
FIG. 4B is an enlarged cross-section of the frame connection.

The frame connection is shown on FIG. 4. The bushings 38 and 39 are permanently fixed onto the frames 14 and 26. The connecting tube 41 holds the frames 14 and 26 together by the locking nuts 43 and 44 and the flat washer 45 on its upper end. A prelubricated plain bearing 40 and a thrust washer 42 facilitate the smooth movement of the rotatable frame 14 in relation to the fixed frame 26. The gearbox connecting shaft 33 rotates within the connecting tube 41.

Figure 5A:
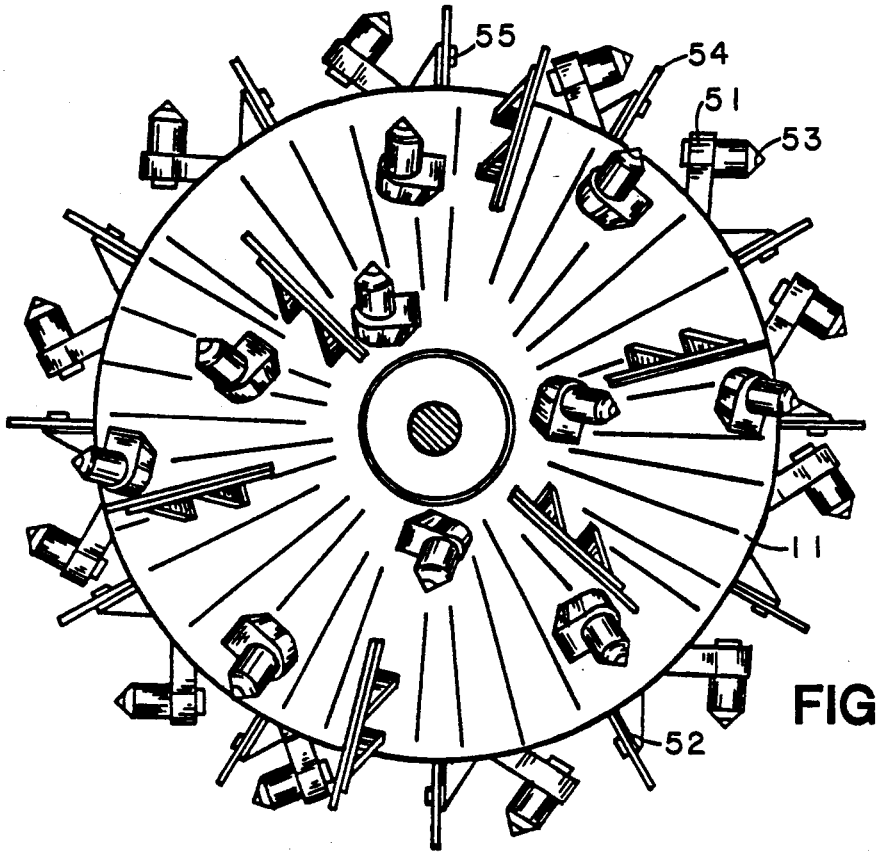
FIG. 5A is a side elevational view of the drum.
Figure 5B:
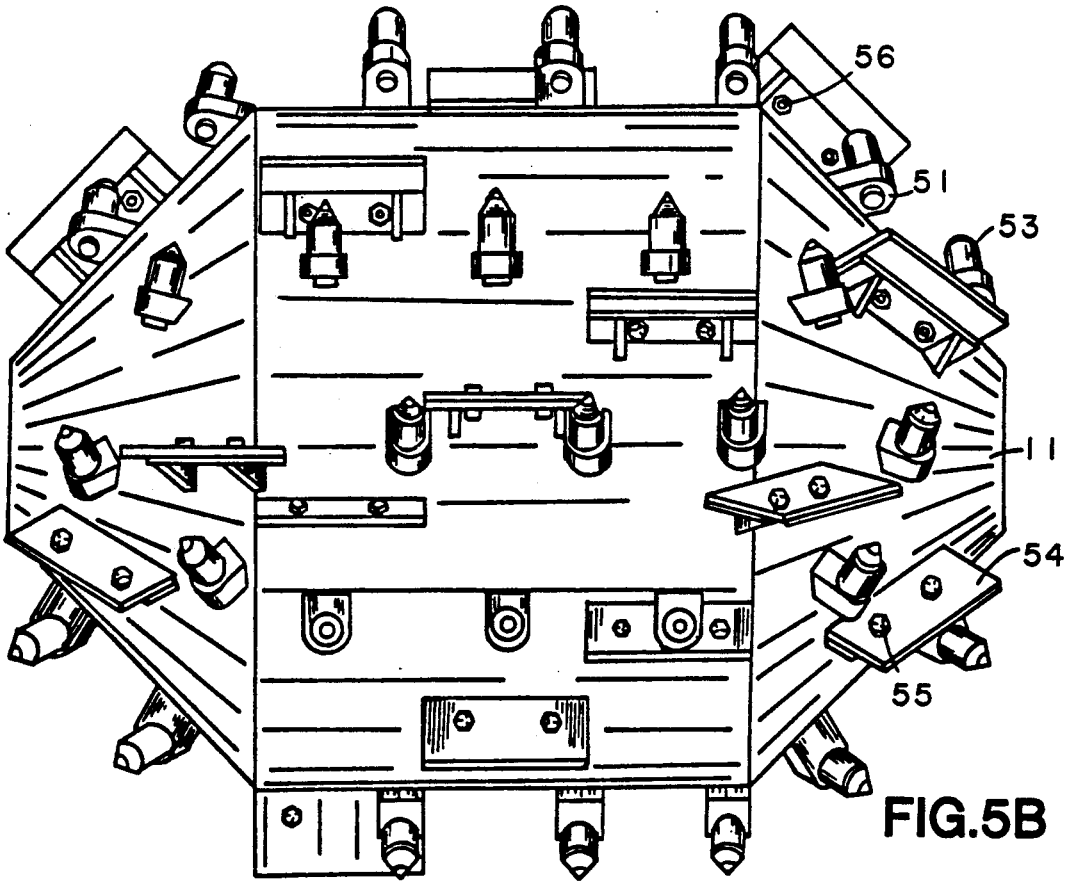
FIG. 5B is a front elevational view of the drum.

FIGS. 5A and 5B illustrate the drum 11 whereon are permanently attached tooth supports 51 and 52, for the carbide teeth 53 and for the flat blades 54 respectively. The carbide tooth support 51 is of the common type that provides a socket hole and retainer means to hold and support the carbide tooth 53. The flat tooth support 52 holds the flat blade 54 by means of bolts 55 and nuts 56. The carbide teeth 53 pulverize the dirt and the occasional rocks and tree stumps that can be found in roadside ditches, while the flat blades 54 that are positioned in an overlapping fashion, eject the pulverized dirt.

Figure 6A:
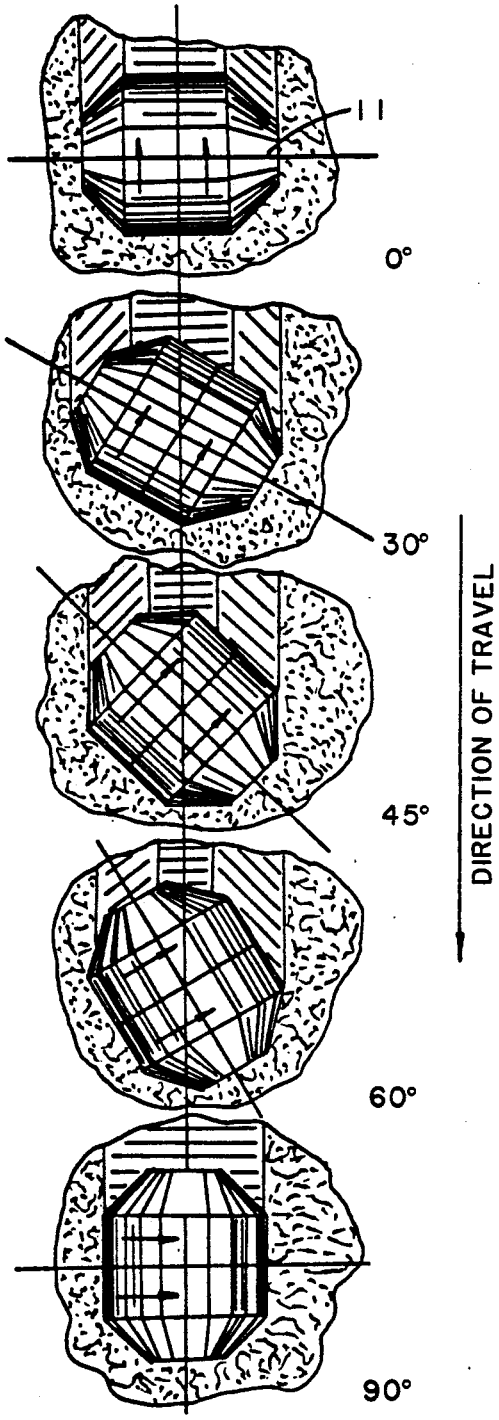
FIGS. 6A and 6B are schematic top and side elevational view of the drum positions with all the supporting frame removed for clarity, where the achievement of the multitude of ditch profiles is shown.
Figure 6B:
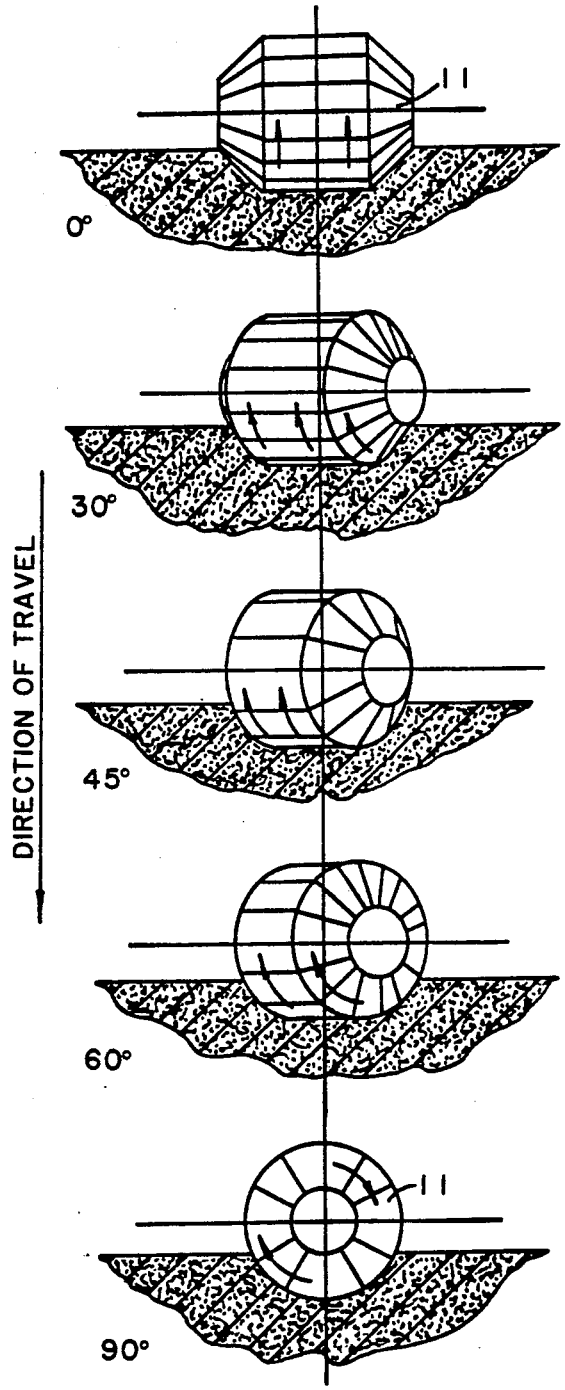
Figure 7A:
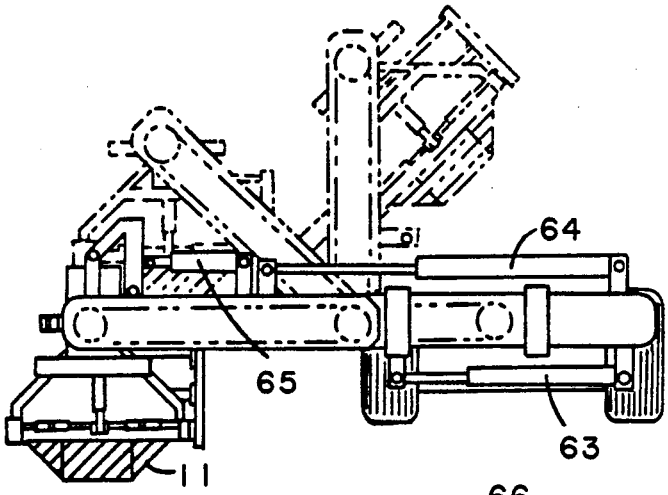
FIGS. 7A and 7B are schematic front and side elevational views of a tractor-pull type carrier.
Figure 7B:
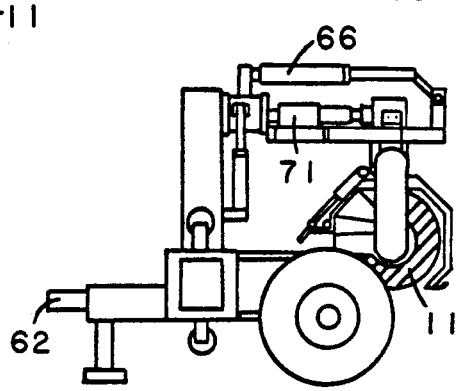
Figure 7C:
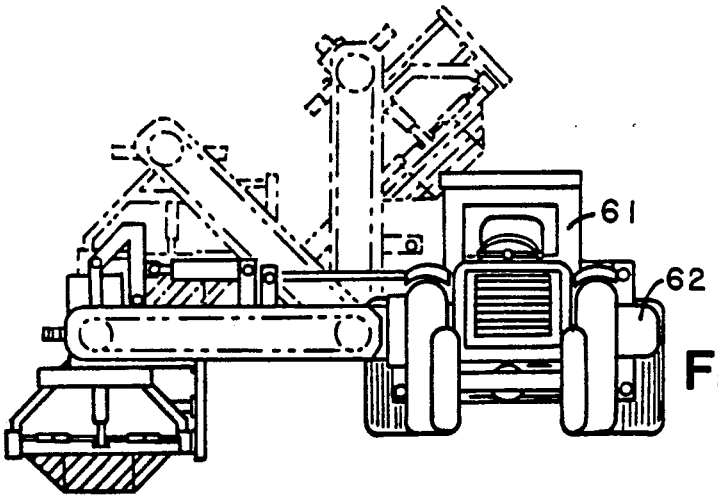
FIGS. 7C and 7D are schematic front and side elevational views of a tractor and a tractor-pull type carrier.
Figure 7D:
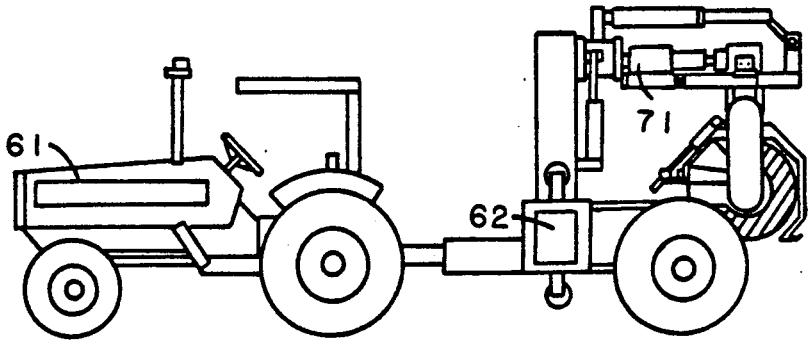

FIGS. 6A and 6B illustrate the drum positions between 0 and 90 degrees and the achievement of the multitude of ditch profiles. It should be mentioned here that 0 degrees is considered the position of the drum where its axis is perpendicular to the road center line (or the carrier line of travel). The drum positioning between −90 and 0 degrees is the mirror image of the positions shown. When the pin 25 of the cylinder 24 is in the middle hole of the disc 23 the cylinder 24 rotates the frame 14 by 60 degrees, between −30 and 30 degrees. This is considered the usual or middle range of the drum 11 positions. As mentioned earlier, by attaching the pin 25 of the cylinder 24 to the outer holes of the disc 23, the cylinder 24 will rotate the frame 14 and the drum 11 between −90 and −30 degrees or 30 and 90 degrees.

FIG. 7 shows schematics of a tractor and tractor-pull type carrier. The tractor 61 pulls and powers the carrier 62. The power transmission to the apparatus can be mechanical (chain, belt), or hydraulic. The carrier provides hydraulic cylinders 63, 64, 65, and 66, for the positioning of the apparatus to its working positions and for lifting it behind the carrier 62 for transportation (transportation positions shown in dotted line).

OPERATION

The hydraulic system of the tractor (remote valves) and a remotely controlled valve-bank, are utilized. The tractor PTO powers the carrier.

The operator positions the apparatus to its working positions by means of the hydraulic cylinders 63, 64, 65, 66 and 24. By rotating the rotatable frame 14 between −30 and 30 degrees utilizing cylinder 24, the operator can disperse the dirt towards the outer bank of the ditch and beyond or towards the road shoulder for later pick-up. Simultaneously the ditch profile will be altered. The operator can open or close the movable door 19 of the panels 18 with the hydraulic cylinder 21, thus restricting the material flow. The restriction of the material flow can be necessary when the excavated material is directed towards the road shoulder for later pick-up, or when the ditch material is to be reclaimed while resurfacing dirt roads.

What I claim is:

1. A ditch digging and cleaning apparatus for producing multiple profile ditches comprising:

a cutting drum having frustoconical end sections extending from each side of a cylindrical mid-section;

a support frame with said cutting drum rotatably mounted thereon about a first axis of rotation;

a mounting frame connected to the support frame about a second axis of rotation, said second axis being substantially perpendicular to said first axis;

drive means for transmission of power to and rotation of said cutting drum and;

means, pivotally connected at a first end to one of a plurality of attachment positions on said support frame and at a second end to said mounting frame, for angular displacement of said cutting drum about the second axis of rotation.

2. The ditch digging and cleaning apparatus of claim 1, wherein said support frame further comprises a skid.

3. The ditch digging and cleaning apparatus of claim 1, wherein the means for positioning comprises a hydraulic cylinder.

4. The ditch digging and cleaning apparatus of claim 3, wherein said attachment positions are pin positioning holes.

5. The ditch digging and cleaning apparatus of claim 1, wherein said attachment positions are pin positioning holes.

6. The ditch digging and cleaning apparatus of claim 1, wherein said support frame further comprises flow controlling panels.

7. The ditch digging and cleaning apparatus of claim 6, wherein said flow controlling panels further comprises a movable door.

8. The ditch digging and cleaning apparatus of claim 1, wherein each of said sections of the cutting drum has a plurality of cutting means.

9. The ditch digging and cleaning apparatus of claim 8, wherein said cutting means further comprises digging teeth and flat blades.

10. The ditch digging and cleaning apparatus of claim 9, wherein the flat blades are arranged in an overlapping pattern for ejecting pulverized dirt.

* * * * *